US005383331A

United States Patent [19]

Proctor

[11] Patent Number: 5,383,331

[45] Date of Patent: Jan. 24, 1995

[54] COMPOSITE COMPRISING STAPLE FIBER AND FILAMENT YARN

[76] Inventor: Charles W. Proctor, 1912 Lafayette Ave., Greensboro, N.C. 27408

[21] Appl. No.: 896,819

[22] Filed: Jun. 11, 1992

[51] Int. Cl.[6] ..... D02G 3/36; D02G 3/02

[52] U.S. Cl. ..... 57/225; 57/224; 57/228

[58] Field of Search ..... 57/210, 224, 285, 226, 57/228, 328

[56] References Cited

U.S. PATENT DOCUMENTS

| | | | |
|---|---|---|---|
| 3,342,028 | 9/1967 | Matsubayashi et al. | 57/225 X |
| 3,343,356 | 9/1967 | McKinnon | 57/225 X |
| 3,822,543 | 7/1974 | Edagawa et al. | 57/328 X |
| 3,845,611 | 11/1974 | Senturk et al. | 57/328 X |
| 3,940,917 | 3/1976 | Strachan . | |
| 4,069,656 | 1/1978 | Arai et al. . | |
| 4,296,597 | 10/1981 | Tani et al. | 57/226 X |
| 4,489,540 | 12/1984 | Faure et al. | 57/328 X |
| 4,497,167 | 2/1985 | Nakahara et al. . | |
| 4,614,081 | 9/1986 | Kim | 57/210 X |
| 4,712,365 | 12/1987 | Ferrer . | |
| 4,757,680 | 7/1988 | Berger et al. . | |
| 4,866,924 | 9/1989 | Stahlecker | 57/328 X |
| 4,921,756 | 5/1990 | Tolbert et al. | 428/373 |
| 4,928,464 | 5/1990 | Morrison . | |

FOREIGN PATENT DOCUMENTS

| | | | |
|---|---|---|---|
| 35049 | 4/1978 | Japan | 57/328 |
| 122829 | 10/1978 | Japan | 57/328 |

*Primary Examiner*—Daniel P. Stodola
*Assistant Examiner*—William Stryjewski
*Attorney, Agent, or Firm*—Darby & Darby

[57] ABSTRACT

A composite yarn comprises a staple fiber component that is formed by drafted sliver. A filament yarn component is formed by applying tension to a filament yarn initially having a crimp such that the crimp is temporarily substantially removed. The staple fiber component and the pretensioned filament yarn component are combined by spinning while the tension is applied to the filament yarn.

10 Claims, 4 Drawing Sheets

COMPOSITE COMPRISING STAPLE FIBER AND FILAMENT YARN

FIELD OF THE INVENTION

The present invention relates generally to yarns and processes for producing yarns and, more specifically, to a composite yarn and a process for producing a composite yarn comprising a multifilament yarn and staple fibers.

BACKGROUND OF THE INVENTION

The basic concept of spinning fibers is centuries old. Spinning staple fibers into useful threads and yarns improved their overall strength, to a limited extent, and allowed the final yarn to be spun with varying degrees of thickness, strength, etc.

With the advent of synthetic textile fibers, the possibility arose for producing continuous filament yarns with greater strength and more durability than those from staple fibers, and also no shrinkage. Unfortunately, the look and feel of fabrics produced solely with synthetic yarns do not meet the high standards demanded by a significant portion of the textile market, especially the clothing industry.

In an attempt to produce yarns with the positive qualities of both staple fibers and synthetic filaments, composite yarns have been manufactured for many years. A well-known method of spinning both homogenous and composite yarns has been ring spinning, which has several advantages. For example, ring spinning produces a strong yarn of high quality, with a low capital investment per spindle. Unfortunately, ring spinning is a comparatively slow process, capable of producing only about 10 to 25 meters of yarn per minute, which greatly increases the cost of the final product. Still, since no other previously known process could produce the strength or feel of ring-spun yarn, this process is still used when the demand for its strength and feel justifies the high costs involved.

Other spinning machines and methods have been developed in more recent years in an attempt to produce a composite yarn with the quality of a ring-spun yarn. Some of these methods include open-end, vacuum, and air-jet spinning, which are capable of output capacities exceeding 10 to 25 times that of ring spinning. One such method is disclosed in U.S. Pat. No. 4,069,656 to Arai etal. Arai describes a process for producing yarns at high speed by feeding a bundle of short fibers along with fine multifilament yarn into a twisting device. The filament yarn is fed at sufficiently low tension and at a faster speed than the fibers such that the fine yarn becomes wrapped around the short fibers. Supposedly, the non-twisted configuration of the fiber bundle provides a good feel to the yarn.

However, the alternating twist of the yarn in this patent precludes its use as a sewing thread, where tear-resistance and high uniformity are required. Additionally, thread made from filament yarns such as that disclosed by Arai have smooth outer surfaces, which causes them to be easily pulled from seams. To date, high quality goods have consistently used mainly ring-spun staple fibers for thread, but as mentioned above, this greatly increases the costs.

Another attempt to create a high-quality composite yarn is disclosed in U.S. Pat. No. 4,866,924 to Stahlecker. A fiber component is first formed by a drawn sliver that is pre-strengthened by false twist spinning. A filament yarn is then taken up with the fiber component onto a spool for subsequent spinning, using a conventional spinning method. According to the patent, when high demands are made on the composite yarn, such as are made on ring-spun staple fibers, it is necessary to rewind the yarn and clean it out so that defects, such as thick or thin points, can be removed. Obviously, the cost involved in rewinding the yarn, among other deficiencies, makes this yarn unacceptable as a viable, cost-effective alternative to ring-spun yarn.

In U.S. Pat. No. 4,928,464 of Morrison, a core filament yarn is tensioned and dragged over the sharp edge of a nonconductive material. After releasing the tension, a crimp develops on the filaments. The crimped filament yarn is then fed into a vacuum spinning device along with nipped sliver or roving. The crimp of the core filaments causes the individual filaments to repel each other and allows the sliver or roving to become partially intermixed with the core during spinning. When the core filaments enter the spinner, they are only tensioned sufficiently to carry them through the apparatus. In the final product, the fibers, while partially intermixed with the core, are relatively loosely spun around the core, allowing them to slide along it and expose the filament yarn beneath. This degrades the look and feel of any fabric produced with the yarn. This sliding phenomenon is known to occur with many existing composite yarns.

The vacuum spinning disclosed by Morrison is faster than conventional ring spinning, but is still considerably slower than air-jet spinning. In vacuum spinning, a shaft having multiple holes is rotated while suction is applied to the holes. This rotating shaft is capable of a rotational speed much less than that caused by air jets. An effective air-jet spinner is disclosed in U.S. Pat. No. 4,497,167 to Nakahara et al. The dual-nozzle system provides high-speed, uniform spinning. The only necessary tension on the entering fibers is that sufficient to carry the fibers through the nozzles.

The type of air-jet spinner disclosed by Nakahara can also be applied to composite spinners, such as the "High-Speed Type Murata Jet Spinner," manufactured by Murata Machinery, Ltd., Kyoto, Japan. This machine is capable of producing 300 meters per minute, while maintaining uniform spinning. Nevertheless, with any of the known air-jet spinners, it has been impossible to achieve a tight enough wrapping of fibers around a core to prevent any slippage or pilling.

SUMMARY OF THE INVENTION

The present invention is directed to a method for manufacturing yarn of staple fibers and continuous multifilament yarn. The multifilament yarn is first heavily pretensioned before entering a spinning chamber where it is co-spun with the staple fibers. The tension is relaxed after passing through the spinning chamber to allow the filaments of the yarn to expand and form a matrix to which the staple fibers can adhere. The expanded filaments cause the staple fibers to be tightly wound around and anchored to the core, preventing any slippage or excess pillage and providing for superior "feel" by preventing the core filaments being exposed.

To the contrary, it has been the practice in the prior art to feed the multifilament yarn at little or no tension in order to improve intermixing with the staple fibers. However, it was surprisingly discovered that pretensioning the textured yarn sufficiently to temporarily remove any crimp prior to spinning dramatically increases the quality and durability of the composite yarn produced.

During spinning, the sliver may be applied with an opposite spin direction to that of the continuous multifilament yarn to create a more balanced yarn. Materials knit from the resulting yarn have high ball burst strength, low random pill test results, and low shrinkage (on the order of 2-3%).

Accordingly, one aspect of the present invention is to provide a two-component composite yarn, including a staple fiber component and a filament yarn component that is tensioned before being spun.

Another aspect of the present invention is to provide a method of co-spinning a continuous filament yarn and staple fibers in a spinner to produce a two-component composite yarn. The method includes the steps of feeding a sliver or roving of the staple fibers through a drafting apparatus to prepare a continuous bundle; pretensioning the filament yarn; combining the continuous bundle of fibers and the filament yarn downstream of said drafting apparatus; and feeding them into a spinner.

Still another aspect of the present invention is to provide a yarn produced according to the above method.

These and other aspects of the present invention will become apparent to those skilled in the art after a reading of the following detailed description of the preferred embodiment in conjunction with a review of the appended drawings.

DETAILED DESCRIPTION OF THE PREFERRED EMBODIMENTS

In the following description, it is to be understood that such terms as "forward", "rearward", "left", "right", and the like are words of convenience and are not to be construed as limiting terms.

Figure 1:
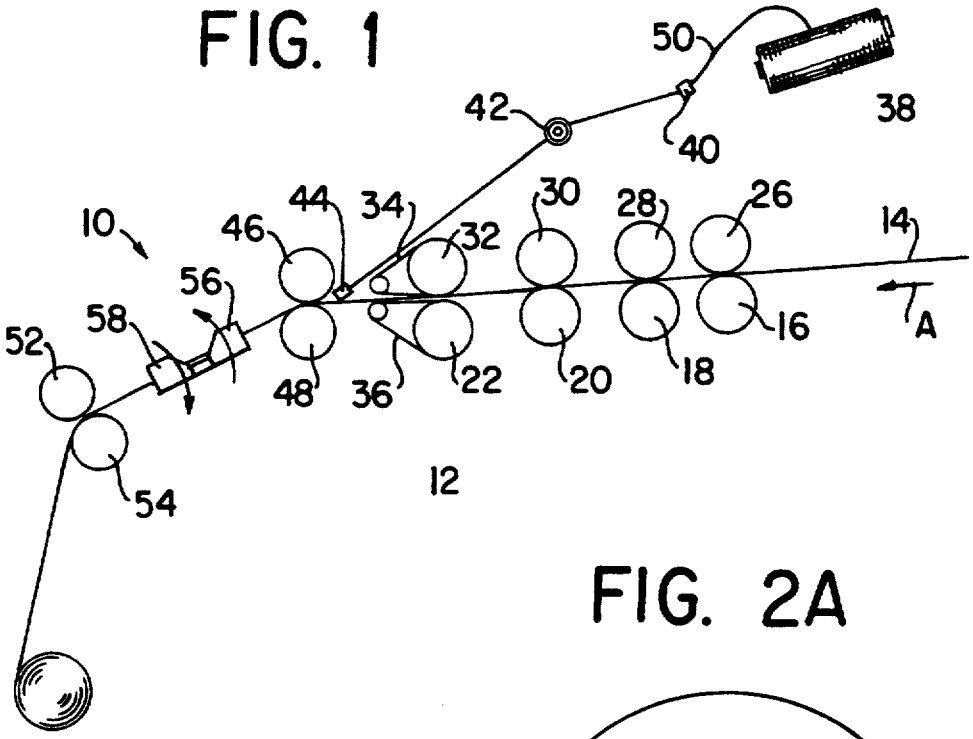
FIG. 1 is a schematic representation of a yarn spinning apparatus constructed according to the present invention.

Now referring to the drawings, as best seen in FIG. 1, there is shown a schematic representation of a yarn spinning apparatus, generally designated 10, constructed according to the present invention.

Spinning apparatus 10 includes a drafting frame 12 to which a staple sliver 14 is fed in the direction of arrow "A". In the drafting frame 12, a staple sliver 14, such as from cotton, is drawn to the desired size, as is known in the art. The drafting frame 12 preferably has bottom rollers 16,18,20,22 and top pressure rollers 26,28,30,32. Top and bottom aprons 34,36 are driven by rollers 32,22, respectively, also as is known. The resulting staple fibers 14 are prepared to be spun.

A stretch textured multifilament S-twist (clockwise twist) yarn 50, such as a stretch "S"-twist 70 denier/34 filament yarn, is withdrawn from yarn supply 38 through guide 40, pretensioning device 42 and ceramic thread guide 44 located downstream of the aprons and before top and bottom nip rollers 46,48. The pretensioning device 42 is preferably an adjustable spring-loaded cymbal tension device that the multifilament yarn 50 is passed through so that the yarn can be adjusted to provide the best results. Other known tensioning devices may be employed.

Figure 2A:
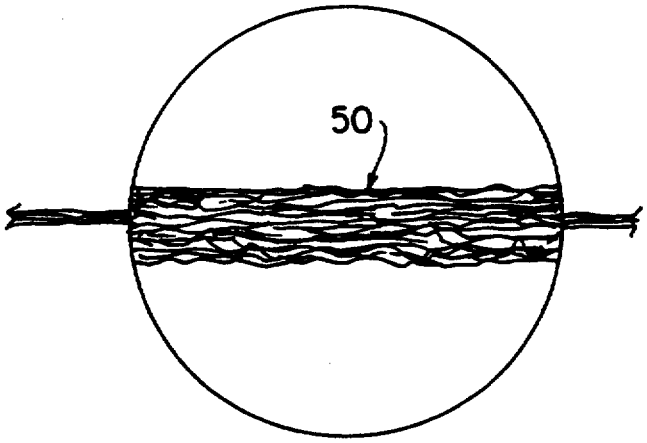
FIGS. 2A-2D are partially magnified schematic views of a yarn at various stages of production according to the present invention.

As seen in FIG. 2A, when the stretch textured "S" twist multifilament yarn 50 is removed from its supply, it is in a crimped state with inter-filament gaps caused by the random abutment of adjacent crimps. The gaps also cause the yarn 50 to have an overall average thickness in its relaxed state substantially exceeding the average thickness in its tensioned state. While only a small number of filaments are shown in FIGS. 2A-2D, it is to be understood that the preferred multifilament yarn is comprised of as many filaments as are necessary to produce the desired final size composite yarn.

Figure 2B:
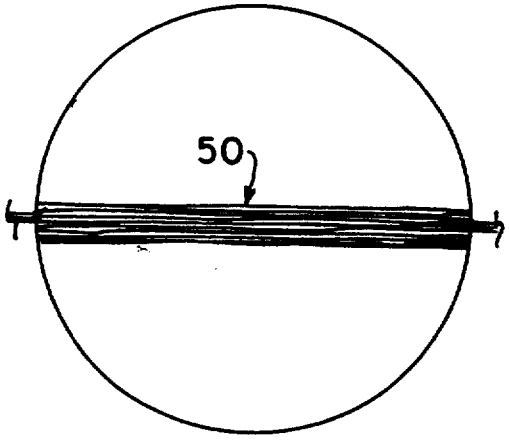

The yarn filaments shown in FIG. 2A exit in that crimped, expanded state from the yarn supply 38 to the pretensioning device 42. After the pretensioning device, the multifilament yarn is pulled sufficiently taut such that the crimp is temporarily substantially removed from the filaments, as seen in FIG. 2B. The multifilament yarn 50 is preferably a synthetic material, such as nylon, rayon, acrylic, polypropylene, spandex, acetate, asbestos, glass filament, polyolefin, carbon fiber, and quartz multifilament yarn. As seen in FIG. 2B, the overall average thickness has been significantly reduced by tensioning yarn 50 and temporarily removing the crimp.

The multifilament yarn 50 then enters between the top and bottom nip rollers 46,48, which maintain the tension on the yarn 50. The tension is similarly maintained between the first nip rollers 46,48 and second nip rollers 52,54.

Figure 2C:
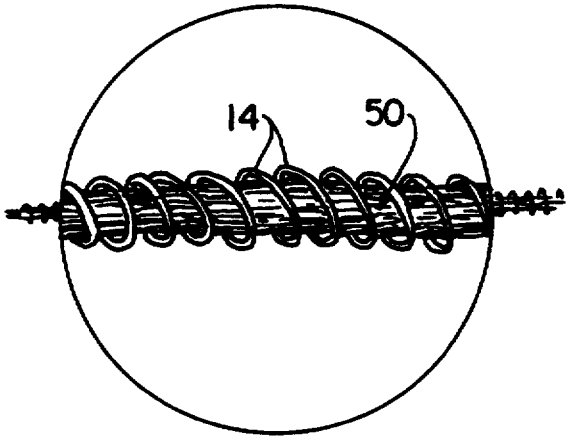
Figure 2D:
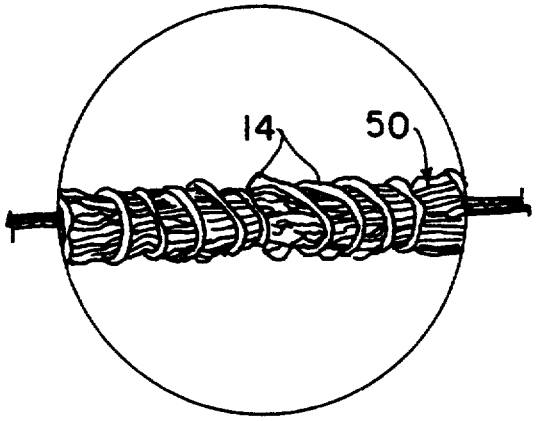
Figure 3:
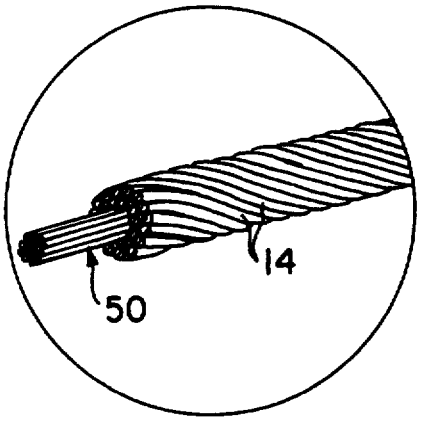
FIG. 3 is a magnified perspective of an end of a completed composite yarn according to the present invention.

At the first nip rollers, the yarn 50 and the staple fibers 14 are combined and fed into the air-jet zone. The air-jet zone is preferably constructed as shown in U.S. Pat. No. 4,497,167. The cotton staple sliver 14 and the core filament yarn 50 enter the first air jet 56 where the loose cotton staple is wrapped around the core yarn 50 with a clockwise rotation, as seen in FIG. 2C. It is to be understood that the cotton staple fibers completely surround the core yarn 50 and that the illustrated single spread-out winding 14 in FIG. 2C, is shown exaggerated, for illustration purposes. Thus, the wrapped staple fibers 14 are shown spaced in order to show the condition of the underlying core. Similar false spacing is shown in FIG. 2D. Preferred covering by the cotton fibers 14 of the core yarn 50 is shown in FIG. 3.

After leaving the first air-jet 56, the combined filament and staple fibers then pass into the second air jet 58 where the combined yarn is subsequently twisted with a counterclockwise rotation. Since in this case, the core filament yarn was processed with a "S" twist (clockwise twist), the core's rotational orientation is opposite the "Z" twist (counterclockwise twist) orientation of the composite yarn, which leads to a stable final yarn with reduced twist. The direction of the two air jets 56,58 can be reversed if the core yarn has been processed with a "Z" twist (counterclockwise twist). The core twist can also be matched to the composite yarn twist to produce a covered yarn with increased twist.

Upon leaving the second air jet 58, the combined yarn passes through second nip rollers 52,54, with the core still under tension and looking much like FIG. 2C. Although exaggerated, the space between the loops of the surrounding staple fibers and the core illustrates how easily the fibers 14 might move along the core 50 if the yarn were completed at this point.

After the second nip rollers 52,54, the core 50 is finally released from its tension, causing it to expand to a state similar to FIG. 2A. However, it is now wrapped with and constrained by the surrounding staple fibers 14, which bind the core and prevent it from reaching its fully expanded state and thus, simultaneously become more taut themselves. This tight wrapping, unattainable through conventional spinning alone, increases the frictional engagement between the staple fibers 14 and the core 50, greatly reducing slippage. The core filaments also tend to enter, but not penetrate, between the surrounding fibers, further increasing the anchoring of the outer fiber cover to the inner core. It will be understood that the final overall thickness of the core 50 after expanding is still less than the original thickness, since it is constrained by the staple fibers.

The process and products according to the present invention will become more apparent upon reviewing the following detailed examples:

EXAMPLE 1

Figure 4:
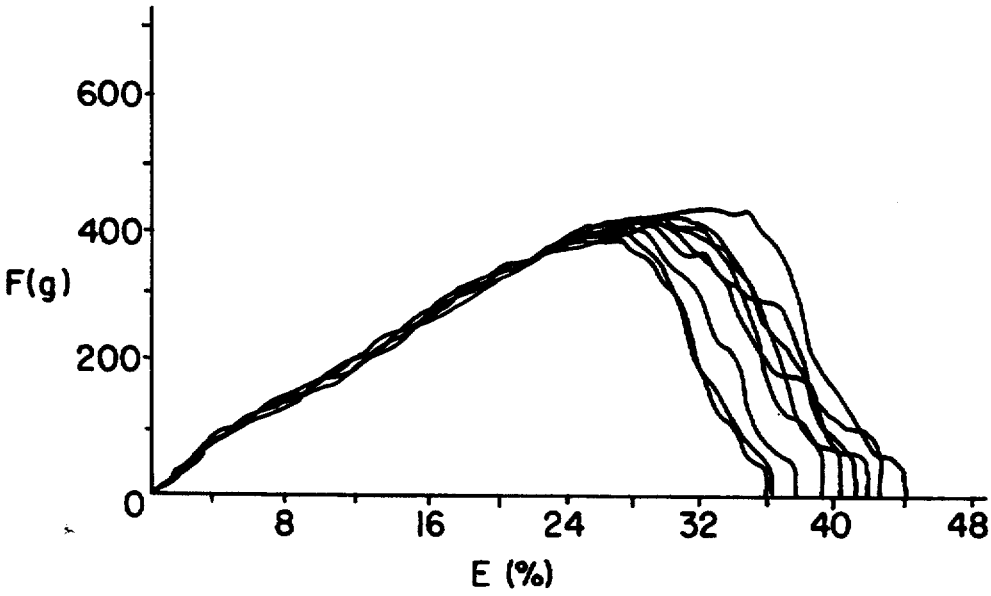
FIGS. 4-8 show graphical representations of the force elongation curves for various example yarns described below.

10 samples of 70 denier 34 filament stretch textured multifilament yarn were tested on a Uster TENSORAPID testing machine. Results of the tests are shown in FIG. 4 and in Table 1 below. As can be seen, the yarn is a relatively high-strength high-elongation yarn with little variation in elongation or B-force (breaking force). The curve shown in FIG. 4 is typical of what would be expected for modern man-made multifilament yarns.

TABLE 1

| | X | V |
|---|---|---|
| Elongation | 29.23% | 7.36 |
| B-Force | 414.20 g | 2.91 |
| Tenacity | 53.31 RKM | 2.91 |
| Work to Rupture | 3499.60 g*cm | 12.89 |

where X is the mean, V is the coefficient of variation, RKM represents grams per Tex (1000 meters), and g*cm represents grams per 100 meters.

EXAMPLE 2

Figure 5:
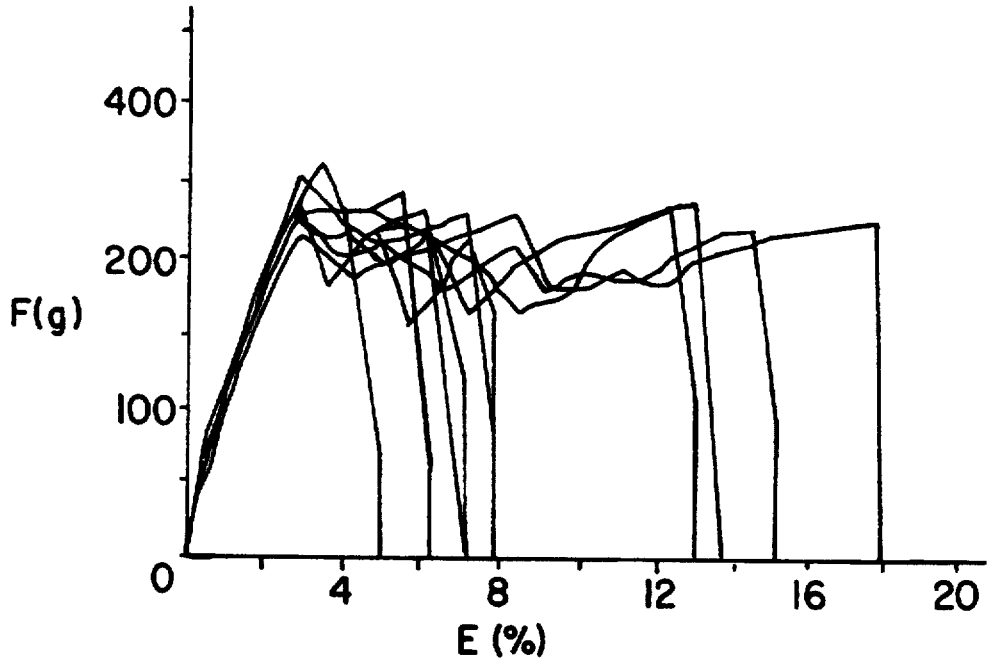

10 samples of a 70 d/34 stretch texture yarn and stable fiber composite yarn were tested on an Uster testing machine. The stretch textured filament yarn was pretensioned at 20 gms. Results of the tests are shown in FIG. 5 and in Table 2 below. As can be seen, the yarn is a relatively low-strength, low-elongation yarn with an undesirable large variation in elongation. The curve shown in FIG. 5 is typical of what would be expected for an incompletely intermixed composite yarn.

TABLE 2

| | X | V |
|---|---|---|
| Elongation | 4.38% | 69.80 |
| B-Force | 240.90 g | 5.43 |
| Tenacity | 7.34 RKM | 5.43 |
| Work to Rupture | 364.74 g*cm | 90.21 |

EXAMPLE 3

Figure 6:
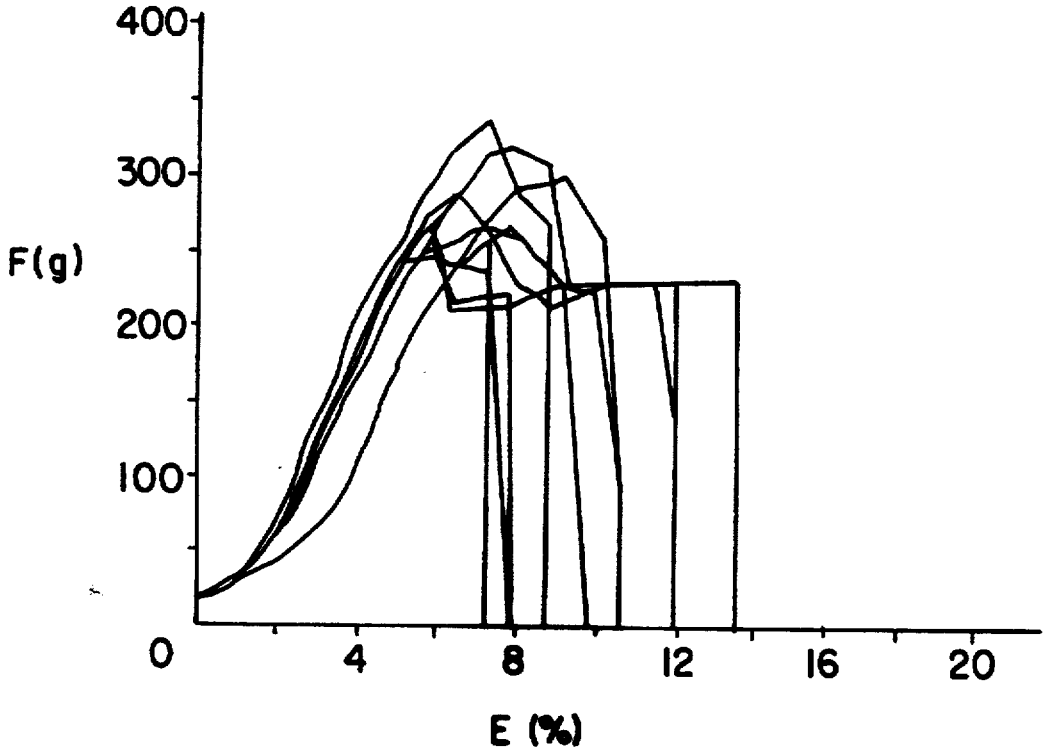

10 samples of a 70 d/34 filament stretch textured yarn and stable fiber composite yarn were tested similarly as above. The filament yarn was pretensioned at 50 gms. Results of the tests are shown in FIG. 6 and in Table 3 below. As can be seen, this yarn also is a low-strength, low-elongation yarn with a large variation in elongation between individual fibers. The curve in FIG. 6 is also typical of what would be expected for an incompletely intermixed composite yarn. However, the "knee" of the curve at about 6% elongation and the lower range of variation in elongation compared to Example 2 indicates that increasing the tension improves the quality of the yarn.

TABLE 3

| | X | V |
|---|---|---|
| Elongation | 6.78% | 15.63 |
| B-Force | 290.66 g | 9.66 |
| Tenacity | 8.86 RKM | 9.66 |
| Work to Rupture | 529.19 g*cm | 23.31 |

EXAMPLE 4

Figure 7:
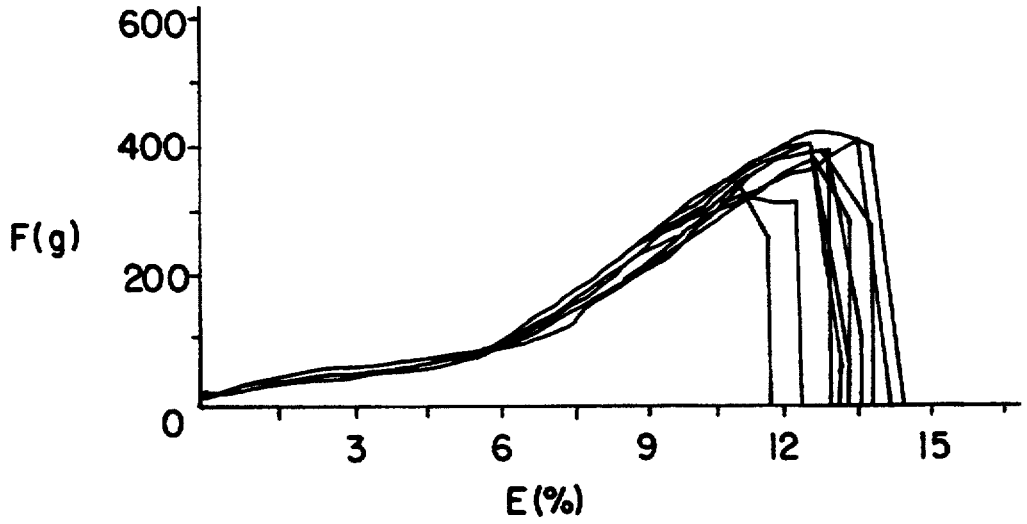

10 samples of a 70 d/34 filament stretch textured filament yarn and staple fiber composite yarn were tested as above. The filament yarn was pretensioned at 75 gms. Results of the tests are shown in FIG. 7 and in Table 4 below. As can be seen, this composite yarn is a higher-strength, higher-elongation yarn with a smaller range of variation in elongation than any of the previous examples. The curve is as expected for a substantially completely intermixed composite yarn. Note the well defined "knee."

TABLE 4

| | X | V |
|---|---|---|
| Elongation | 12.61% | 5.77 |
| B-Force | 370.91 g | 7.73 |
| Tenacity | 11.31 RKM | 7.73 |
| Work to Rupture | 984.71 g*cm | 14.06 |

EXAMPLE 5

Figure 8:
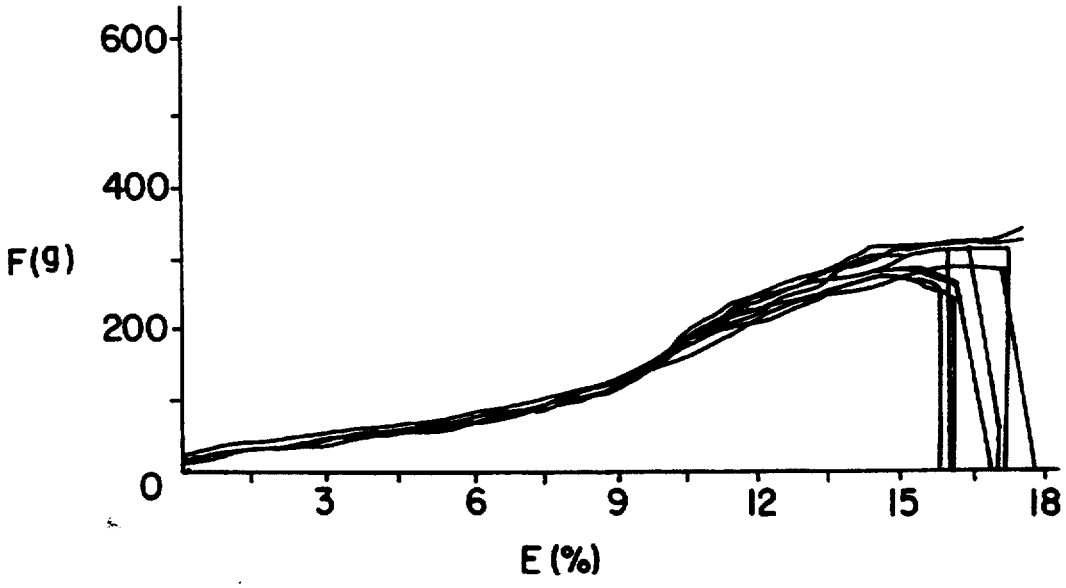

10 samples of a 70 d/34 filament stretch textured yarn and staple fiber composite yarn were tested as above. The filament yarn was pretensioned at 150 gms. Results of the tests are shown in FIG. 8 and in Table 5 below. As can be seen, this yarn is also a higher-strength, higher-elongation yarn with a small variation in elongation. The curve shown in FIG. 8 is typical of what would be expected for an intermixed composite yarn. Note the well defined "knee." However, the Tenacity value is slightly lower than for Example 4 indicating additional pretensioning would not produce a better quality yarn.

TABLE 5

| | X | V |
|---|---|---|
| Elongation | 16.21% | 6.37 |
| B-Force | 301.36 g | 8.47 |
| Tenacity | 9.19 RKM | 8.47 |
| Work to Rupture | 1147.74 g*cm | 17.82 |

EXAMPLE 6

150 d/34 filament stretch textured yarn was evaluated for testing as above. While not actually tested, it is expected that if tested the results of the tests would be as shown in Table 6 below. Elongation and tenacity are material dependent properties and are expected not to change with denier. However, B-force, which is dependent on denier, is expected to about double.

TABLE 6

| | X | V |
|---|---|---|
| Elongation | 29.23% | 7.36 |
| B-Force | 818.40 g | 2.91 |
| Tenacity | 53.31 RKM | 2.91 |

EXAMPLE 7

150 d/34 filament stretch textured yarn and staple fiber composite yarn were evaluated for testing as above. If it is assumed that the filament yarn was pretensioned at 150 gms, the results shown in Table 7 below are anticipated to closely follow the results of the 70 d filament yarn pretensioned at 75 gms (see Table 4 for comparison). Elongation and tenacity are material dependent properties and are expected not to change with denier. However, B-force, which is dependent on denier, is expected to about double when comparing 70 denier to 150 denier.

TABLE 7

| | X | V |
|---|---|---|
| Elongation | 12.61% | 5.77 |
| B-Force | 741.82 g | 7.73 |
| Tenacity | 11.31 RKM | 7.73 |

It is to be understood that in place of the cotton staple fibers, similar staple fibers such as rayon, polypropylene, acetate, asbestos, nylon, polyester, acrylic, wool, cashmere, alpaca, mohair, linen, silk and polyolefin could be substituted.

Fabric Advantages

Fabrics produced with yarns according to the present invention display several advantages with respect to other fabrics, such as 100% cotton and conventional poly/cotton blends. These advantages include less pilling and higher ball burst strength. The fabrics also have high uniformity and even cover, due to the reduced slippage of the cover staple fibers and the evenness of the filament core yarn.

In the embodiment of the yarn in which the core has the reverse twist of the cover fibers, there is less fabric biasing. This reduces the tendency of hems or other garment parts to torque or bias. The fabrics produced with yarns according to the invention also exhibit lower shrinkage, i.e., less than 2–3%, compared to typical cotton fabric, which exhibits 12–14% shrinkage. Therefore, there are lower finishing costs, since no formaldehyde-based resin is necessary to decrease the shrinkage as with the cotton fabric.

Therefore, the composite yarns of the present invention and fabrics produced with them exhibit the positive qualities of filament yarns and staple fibers, while avoiding the negative qualities of both.

It is to be understood that while the embodiments shown and described are fully capable of achieving the above objects and advantages, these embodiments are shown and described only for the purpose of illustration and not for the purpose of limitation.

What is claimed is:

1. A composite yarn, comprising:
a staple fiber component formed by drafted sliver;
a filament yarn component formed by applying tension to a filament yarn initially having a crimp such that said crimp is temporarily substantially removed, said filament yarn having a first predetermined thickness in a relaxed state,
wherein said staple fiber component and said pretensioned filament yarn component are combined by spinning while said tension is applied to said filament yarn to stretch said filament yarn to a second thickness that is less than said first thickness, said staple fiber substantially covers the filament yarn component and confines the filament yarn component to said second thickness, said filament yarn is a stretch textured multifilament yarn.

2. The composite yarn according to claim 1, wherein said staple fiber is cotton.

3. The composite yarn according to claim 1, wherein the ratio of said filament yarn to said staple fiber is between 40/60 and 60/40.

4. The composite yarn according to claim 1, wherein said filament yarn is between 70 and 150 denier.

5. The composite yarn according to claim 1, wherein the pretensioning of said filament yarn is between one and two grams per denier.

6. The composite yarn according to claim 5, wherein the pretensioning of said filament yarn is one gram per denier.

7. A composite yarn, comprising:
a core of multifilament yarn, said multifilament yarn having a crimp and a first predetermined thickness in a relaxed state; and
a sheath of staple fibers substantially covering said core, said sheath confining said core to a second thickness less than said first thickness.

8. A composite yarn, comprising: a staple fiber cover strand and a multiple filament core component, said multiple filament core component having a first predetermined thickness in a relaxed state, said fiber cover strand being circumferentially wound around and substantially covering said core component while a tension is applied to said multiple filament core component to stretch said multiple filament core component and said multiple filaments of said core being expanded, when said tension is released, outwardly into friction locking engagement with said circumferentially wound fiber cover strand whereby the multiple filament core component is confined to a second thickness that is less than the first thickness.

9. A composite yarn as in claim 8, wherein said multiple filament core is of such structure that, in a contracted condition thereof, it exhibits an outside diameter substantially smaller than the diameter thereof in said expanded friction locking condition thereof.

10. A composite yarn as in claim 8 wherein said multiple filament core is in said contracted condition when said fiber cover strand is wound thereabout and is adapted to expand into said expanded locking friction condition thereof after said fiber core strand has been wound thereabout.

* * * * *